US007011036B1

(12) United States Patent
Hill

(10) Patent No.: US 7,011,036 B1
(45) Date of Patent: Mar. 14, 2006

(54) BOAT BOARDING RAMP

(76) Inventor: Jeffrey C. Hill, 768 Tomahawk Trail, Coldwater, MI (US) 49036

( * ) Notice: Subject to any disclaimer, the term of this patent is extended or adjusted under 35 U.S.C. 154(b) by 0 days.

(21) Appl. No.: 11/127,450

(22) Filed: May 12, 2005

(51) Int. Cl.
*B63B 17/00* (2006.01)

(52) U.S. Cl. ..... 114/362

(58) Field of Classification Search ..... 114/362
See application file for complete search history.

(56) References Cited

U.S. PATENT DOCUMENTS

| | | | | |
|---|---|---|---|---|
| 2,964,767 | A | 12/1960 | Egbert | |
| 3,134,999 | A | 6/1964 | Reynolds | |
| 3,195,680 | A | 7/1965 | Thornburg et al. | |
| 3,498,410 | A * | 3/1970 | Storch | 182/96 |
| 3,570,029 | A | 3/1971 | Hunsaker | |
| 3,587,123 | A | 6/1971 | O'Boyle | |
| 3,794,140 | A | 2/1974 | Sell | |
| 3,891,053 | A | 6/1975 | Burton | |
| 3,892,290 | A | 7/1975 | Lang | |
| D243,854 | S | 3/1977 | Pelkey | |
| 4,186,820 | A | 2/1980 | Cosman | |
| 4,293,967 | A | 10/1981 | Ord | |
| 4,538,314 | A | 9/1985 | Baranowski | |
| 4,724,925 | A | 2/1988 | Ritten | |
| 4,799,447 | A | 1/1989 | Hebert et al. | |
| 4,989,691 | A | 2/1991 | Wilkerson et al. | |
| 5,123,372 | A | 6/1992 | Kobayashi et al. | |
| 5,213,060 | A | 5/1993 | Sloan et al. | |
| 5,515,806 | A | 5/1996 | McCabe | |
| 5,592,801 | A | 1/1997 | Balzer | |
| 5,634,440 | A | 6/1997 | Mogck | |
| 5,829,380 | A | 11/1998 | Smith | |
| D412,224 | S | 7/1999 | Adler | |
| D420,175 | S | 2/2000 | Garrels, Jr. | |
| 6,067,926 | A * | 5/2000 | Robinson | 114/362 |
| 6,119,809 | A | 9/2000 | McClendon, Jr. | |
| 6,267,082 | B1 | 7/2001 | Naragon et al. | |
| 6,578,510 | B1 | 6/2003 | Scruggs et al. | |
| 6,643,879 | B1 | 11/2003 | Davis | |
| 6,715,177 | B1 | 4/2004 | Lagergren-Julander | |
| 6,722,307 | B1 | 4/2004 | Rogers | |
| 6,941,889 | B1 * | 9/2005 | McCrocklin et al. | 114/362 |
| 2005/0028719 | A1 | 2/2005 | Everett | |

* cited by examiner

*Primary Examiner*—Jesus D. Sotelo
(74) *Attorney, Agent, or Firm*—Frederick W. Mau, II

(57) ABSTRACT

A boarding ramp for entering a boat from the surrounding water. The boarding ramp is vertically swingable from a raised position and a lowered position. The boarding ramp is designed such that the ramp portion is supported against the boat during use in both calm and rough water.

20 Claims, 6 Drawing Sheets

BOAT BOARDING RAMP

FIELD OF THE INVENTION

The present invention generally relates to a boarding ramp for a boat. More particularly, the present invention relates to a boarding ramp allowing entry to a boat from the surrounding water and/or entry to the surrounding water from the boat. The boarding ramp has a raised position where the boarding ramp is removed from the surrounding water and a lowered position where at least a portion of the boarding ramp is submerged in the surrounding water.

BACKGROUND

Boating is a popular activity enjoyed by people worldwide. When boating, whether for hunting or recreation, many people bring along their dogs. People often allow their dogs to enter the surrounding water from the boat, whether to go swimming or to retrieve wild game. After dogs enter the water from the boat, they can become extremely difficult to lift back into the boat. By attempting to lift the dog back into the boat, injuries may occur to both the person attempting to lift the dog back into the boat and to the dog itself.

To prevent injuries to dog owners and dogs alike, many dog ramps have been designed to freely allow dogs to enter boats from and exit boats to the surrounding water. Examples of these types of ramps are disclosed in U.S. Pat. Nos. 3,570,029, 3,891,053, 4,538,314, 5,829,380, 6,119,809, and 6,722,307.

In U.S. Pat. No. 3,570,029 entitled Combination Boat Seat And Gangplank, there is disclosed a ramp including a series of telescoping portions. The ramp further includes a pivotal mounting that allows the entire unit to be swung around a pivot point. When extended for use as a gang plank, the ramp is supported by the pivotal mounting attached to the top of the inner side of the boat and the gunwale of the boat. With no further support for the for the ramp when in the extended position, a great deal of strain may be placed on the pivotal mounting during use. Furthermore, the grade of the ramp may not be varied as needed.

In U.S. Pat. No. 3,891,053 entitled Dog Ladder For Boats, there is disclosed a dog ramp pivotally attached to the side of a boat. The top portion of the ramp includes a mounting portion allowing the ramp to be clamped onto the side of a boat. The ramp is adapted to extend into the water when mounted onto a boat. The mounting portion allows the ramp to be pivoted in a range of about 180°. The ramp may be turned so that it is substantially parallel with the boat so as not to impede forward movement of the boat. During use, the ramp is supported entirely by the mounting portion clamped to the rail of the boat. This may cause a great deal of strain on the mounting portion of the ramp. Furthermore, the mounting portion of the ramp does not allow the ramp to be raised into the boat while still attached to the rail of the boat. The ramp is also not vertically swingable which may create difficulty when attempting to climb onto the ramp in rough water.

In U.S. Pat. No. 4,538,314 entitled Boarding Ramp, there is disclosed a removable and adjustable ramp for aiding an animal or human into a small boat from water in which the boat is floating. The ramp is removably mounted over the side of the boat by a pair of support arms having an upper hook portion which encompasses the top lip of the side of the boat. When mounted to the side of the boat, each support arm extends substantially vertically downwardly abutting the outer surface of the side of the boat. The upper portion of the ramp is connected to the top of the support arms and the lower portion of the ramp is connected to the lower portion of the support arms by braces. The boarding ramp includes a plurality of apertures for adjusting the ramp to a variety of angular positions. The boarding ramp, however, does not swing into the boat when connected to the side of the boat. To raise the boarding ramp into the boat, the entire unit must be removed from the side of the boat. The boarding ramp is also not vertically swingable which may cause difficulty when attempting to climb onto the ramp in rough water.

In U.S. Pat. No. 5,829,380 entitled Boat Boarding System For Dogs, there is disclosed a pair of platform segments hingedly attached to one another, whereby the inner platform segment is secured to the drop ladder of the boat. The underside of the end of the second platform segment has a pair of flotation bags attached thereto. The ramp, however, may not be attached to the gunwale or deck of a boat whereby the ramp can be raised into the boat while still attached to the gunwale or deck. The ramp also does not have any support which may cause difficulty when attempting to climb onto the ramp in rough water.

While many ramps have been designed to allow dogs to enter and exit boats from the surrounding water, there is still a need for improvements in the manner in which the such ramps are raised, lowered, stored in the boat, and supported during use. The present invention overcomes a number of shortcomings in the prior art by including several features which make the boarding ramp useable in both calm and rough water conditions.

SUMMARY OF THE INVENTION

The present invention is directed to a boarding ramp for a boat. The boarding ramp comprises a ramp portion having an upper end, a lower end, an upper surface, and a bottom surface. The upper end of the ramp portion may be hingedly connected to the boat. The ramp portion has a raised position whereby the ramp portion is above the waterline of the boat and a lowered position whereby the lower end of the ramp portion is at least partially below the waterline of the boat. The ramp portion may be vertically swingable between the raised position and the lowered position. The boarding ramp may further comprise a slip resistant material deposited on the upper surface of the ramp portion. The ramp portion may comprise one or more telescoping portions for extending the length of the ramp portion. The ramp portion may comprise one or more holes extending through the ramp portion from the upper surface to the bottom surface to prevent water from becoming trapped on the upper surface of the ramp portion.

The boarding ramp further comprises one or more buoyant support arms attached to the ramp portion. The one or more buoyant support arms may be vertically swingable with respect to the ramp portion. The one or more buoyant support arms support the ramp portion against the outside of the boat when the boarding ramp is in the lowered position. The one or more buoyant support arms each comprise an elongated member having a first end and a second end. The first end of each of the one or more support arms may be attached to the ramp portion and the second end of the one or more buoyant support arms may be disposed at a position proximate to the waterline of the boat when the ramp portion is in the lowered position. The first end of the one or more buoyant support arms may be hingedly connected to the bottom surface of the ramp portion. The one or more buoyant support arms may comprise a pair of support arms, whereby the first end of each of the buoyant support arms in the pair or support arms are rotatably connected to opposite sides of the ramp portion. The one or more buoyant support arms may comprise a buoyant material and/or have a buoyant material attached thereto. The boarding ramp may further comprise a cross bar attaching the pair of buoyant support arms to one another. The cross bar may comprise a buoyant material and/or have a buoyant material attached thereto.

The ramp portion may include one or more pairs of opposable apertures disposed on opposite sides of the ramp portion. The one or more pairs of opposable apertures receive means for rotatably connecting the first end of each of the buoyant support arms to the ramp portion.

The boarding ramp may comprise a hinging unit fixedly connected to the boat and the upper end of the ramp portion. Alternatively, the boarding ramp may comprise a hinging unit fixedly connected to the upper end of the ramp portion and detachably connected to the boat. The detachably connected hinging unit may comprise one or more hooks and/or one or more clamps for detachably connecting the ramp portion to the bow, bow side deck, stern, stern side deck, transom, or gunwale of any type boat or near any part of the edge of the deck of a pontoon boat.

The boarding ramp may further comprise a plurality of rectangular steps horizontally disposed on the upper surface of the ramp portion, the plurality of rectangular steps being spacedly disposed from one another. The plurality of rectangular steps may have a slip resistant material deposited thereon. The boarding ramp may further comprise side rails vertically disposed along the sides of the ramp portion.

The boarding ramp may further comprise means for swinging the boarding ramp between the raised position and the lowered position. The means for swinging the boarding ramp between the raised position and the lowered position may be selected from a rope, chain, gaff, hook, pole, or any other objects having one end attachable to the boarding ramp allowing the boarding ramp to be pulled above the waterline and into the boat.

The boarding ramp may also have a closed position. When in the closed position, the boarding ramp may rest in the boat or flat on the deck of the boat.

DETAILED DESCRIPTION OF THE PREFERRED EMBODIMENTS OF THE INVENTION

Disclosed herein, is a boarding ramp for boarding a boat from the surrounding water and allowing entrance to the surrounding water from the boat. The boarding ramp is easily lowered into the surrounding water from the boat and raised from the surrounding water into the boat. The boarding ramp is particularly useful for allowing a dog to enter a boat from and exit a boat to the surrounding water, however, the boarding ramp may also allow people to enter and exit the boat. The boarding ramp is vertically swingable between a raised position where all components of the boarding ramp are above the waterline of the boat and a lowered position where at least a portion of the boarding ramp extends below the waterline of the boat. The boarding ramp may also have a closed position where the boarding ramp lies inside the boat or flat on the deck of a boat. While the boarding ramp is intended for use with a boat, the boarding ramp may also be attached to and used in conjunction with a dock, floating swim platform, or any other object disposed adjacent to a body of water.

Figure 1:
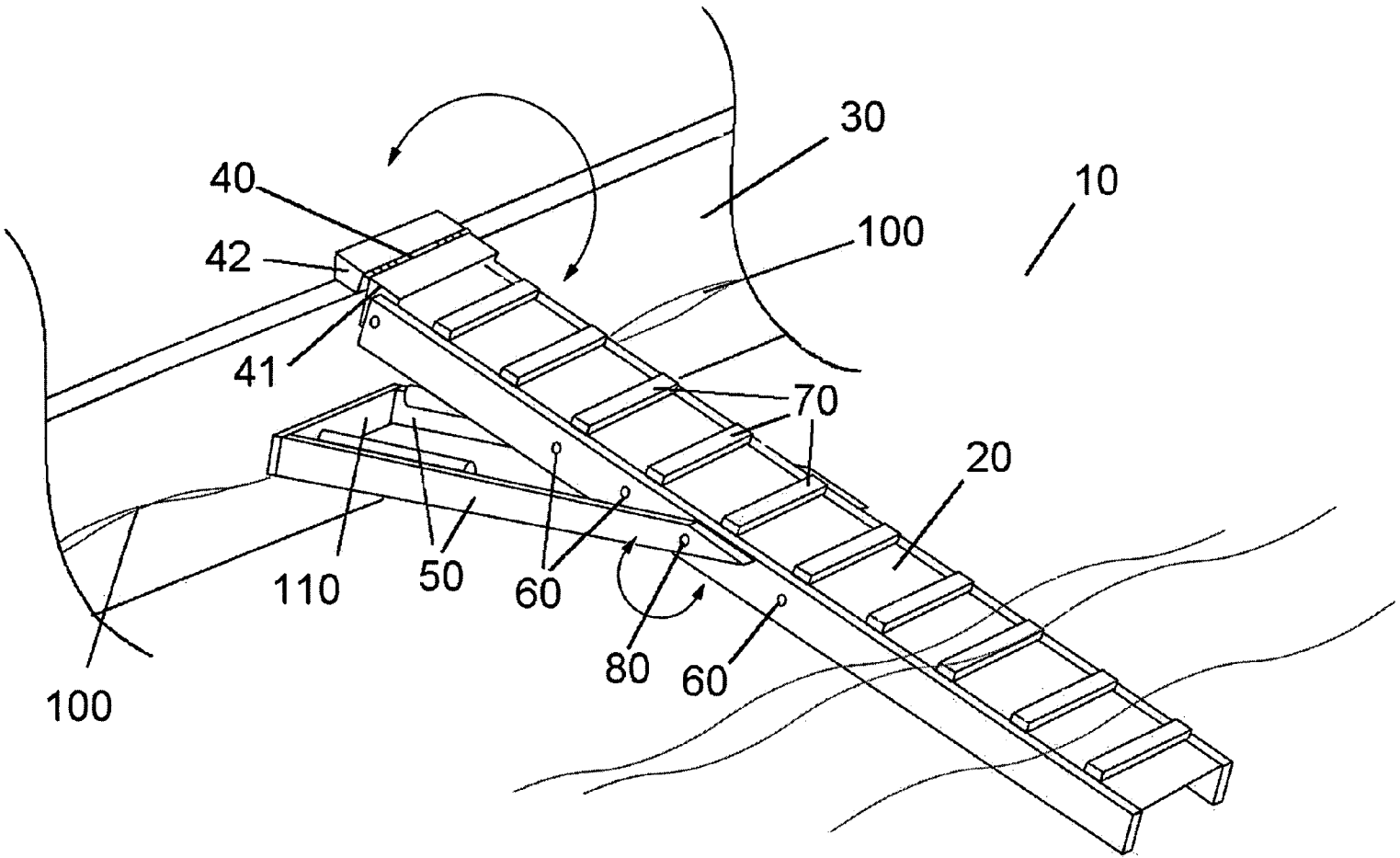
FIG. 1, is a depiction of a preferred embodiment of the boarding ramp in accordance with the present invention whereby the boarding ramp is in a lowered position.
Figure 2:
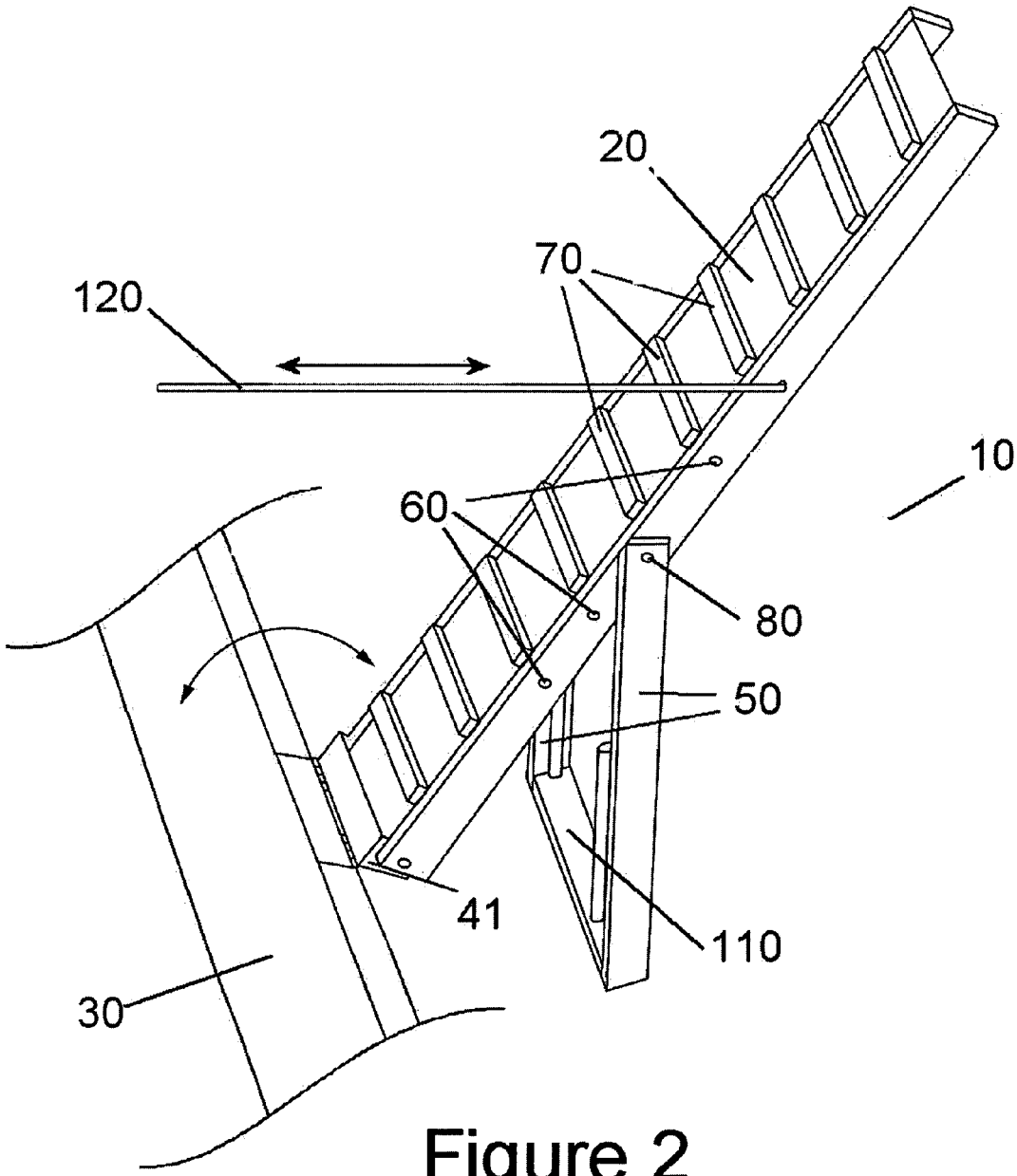
FIG. 2, is a depiction of a preferred embodiment of the boarding ramp in accordance with the present invention whereby the boarding ramp is in a raised position.

FIG. 1 is a depiction of a preferred embodiment of the boarding ramp in accordance with the present invention whereby the boarding ramp 10 is in a lowered position. FIG. 2 is a depiction of the preferred embodiment of the boarding ramp in accordance with the present invention whereby the boarding ramp 10 is in a raised position. The boarding ramp 10 generally comprises a ramp portion 20 hingedly connected to the boat 30 via one or more hinging units 40. The boarding ramp 10 further comprises one or more support arms 50 connected to the ramp portion 20 for supporting the ramp portion 20 against the boat 30 when the boarding ramp 10 is in the lowered position. Preferably, the boarding ramp 10 comprises a pair of support arms. The ramp portion 20 may be fixedly connected or detachably connected to the bow, bow side deck, stern, stern side deck, transom, or gunwale of any type boat or near any part of the edge of the deck of a pontoon boat.

The ramp portion 20 generally comprises a flat rigid surface. Preferably, the ramp portion has a rectangular or square shape. The ramp portion has an upper end, a lower end, an upper surface, and a bottom surface. The upper end of the ramp portion is hingedly attached to the bow, bow side deck, stern, stern side deck, transom, or gunwale of a boat such that the lower end of the ramp portion is vertically swingable allowing the boarding ramp 10 to be raised from or lowered into the surrounding water.

The ramp portion 20 may include two or more telescoping portions. By having two or more telescoping portions, the length of the ramp portion may be extended as needed. The ramp portion may be solid or have one or more holes extending through the ramp portion from the upper surface to the lower surface. The one or more holes should be small enough so as not to impede the ability of the person or animal to climb up or descend down the ramp portion. The ramp portion may also have a mesh or grate configuration. By having one or more holes through the ramp portion or by utilizing a rigid mesh material for the ramp portion the boarding ramp may be easier to lift into a raised position by minimizing the weight of the ramp portion due to the amount of water trapped on the upper surface of the boarding ramp. By minimizing the amount of water trapped on the upper surface of the ramp, the amount of water transferred into the boat upon raising the boarding ramp into the boat may also be minimized. The ramp portion may be formed from any type of rigid material, such as wood, treated wood, composite materials, metal, polymeric materials, and the like. The ramp portion may also comprise a slip resistant material deposited on the upper surface of the ramp portion. The slip resistant material may be any material known in the art to prevent slippage on a wet surface.

The sides of the ramp portion may further comprise one or more pairs of apertures 60, whereby each pair of apertures 60 includes two apertures on opposable sides of the ramp portion from one another. Each of the apertures are designed to receive a male connector 80 from the one or more support arms 50 thereby allowing the one or more support arms 50 to be rotatably connected to the sides of the ramp portion 20. By having two or more pairs of apertures 60, the grade of the ramp portion 20 may be increased or decreased as desired by inserting the male connectors 80 into different pairs of apertures 60.

The ramp portion 20 may also comprise a plurality of steps 70 horizontally disposed on the upper surface of the ramp portion 20 whereby each of the plurality of rectangular steps 70 are spacedly disposed from one another. The plurality of steps aid in climbing up the boarding ramp 20 into the boat and/or descending down the boarding ramp into the surrounding water. The steps 70 preferably have a square or rectangular cross-section. Preferably, the height of each of the steps may be at least 1 inch. More preferably, the height of each of the steps may be at least 1.5 inches. The steps may be comprised of wood, treated wood, metal, composite materials, polymeric materials, and the like. The steps may also have a slip resistant material deposited thereon.

The ramp portion 20 may further comprise side rails vertically disposed along the sides of the ramp portion or along the sides of the upper surface of the ramp portion. The side rails aid in preventing the animal or person using the ramp from sliding off the side of the ramp when climbing up the ramp into the boat or descending down the ramp into the surrounding water. The side rails may have a rectangular or square cross section. Preferably, the height of each of the side rails is at least 1 inch. More preferably, the height of each of the side rails is at least 1.5 inches. The side rails may be comprised of wood, treated wood, metal, composite materials, polymeric materials, and the like. The side rails may have a slip resistant material deposited thereon.

Each of the one or more support arms 50 generally comprise an elongated member having a first end and a second end opposite the first end. The first end of each support arm is hingedly connected or rotatably connected to the ramp portion 20 of the boarding ramp 10.

Figure 3:
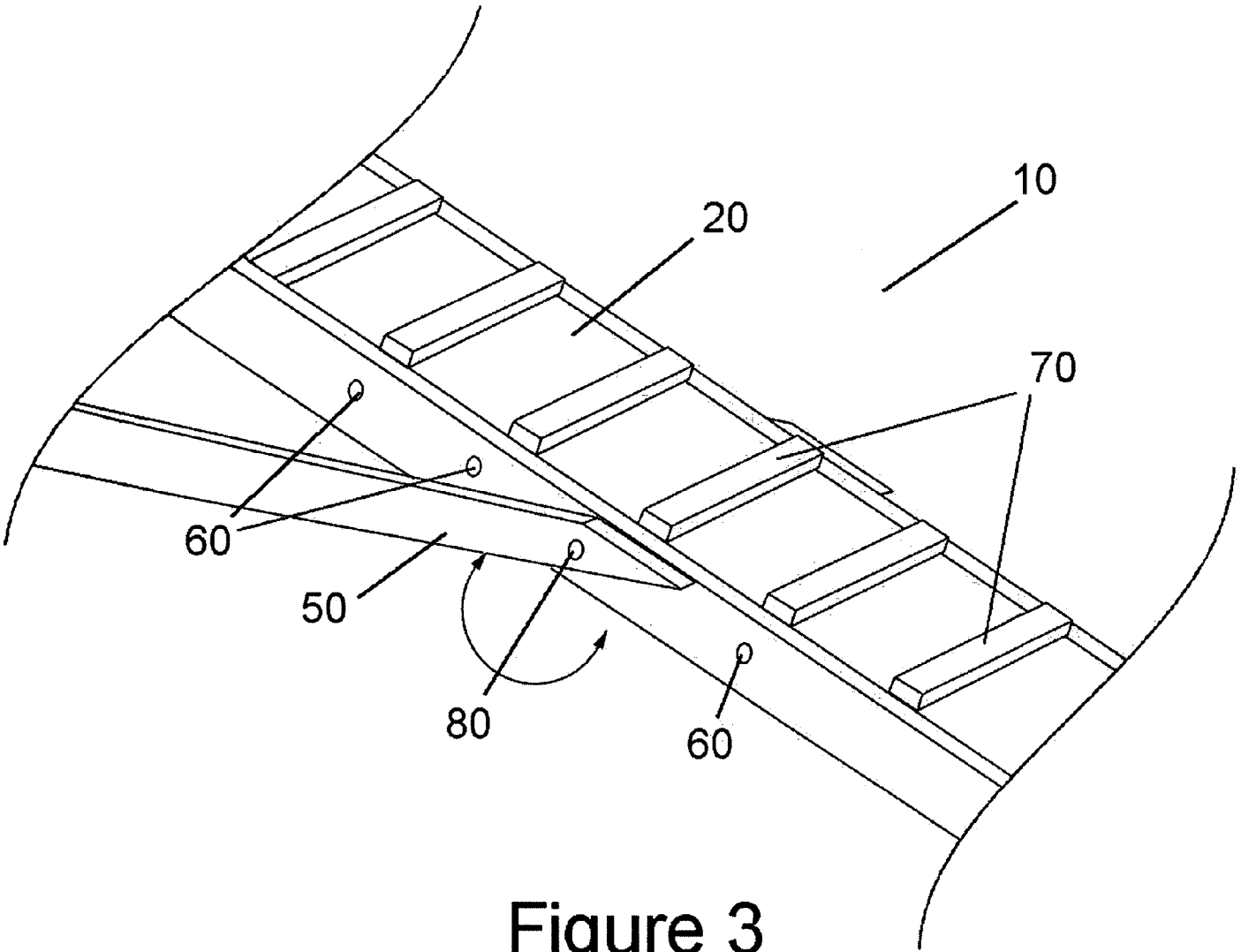
FIG. 3, is a depiction of boarding ramp in accordance with the present invention whereby the support arms are rotatably connected to the ramp portion.

Preferably, the one or more support arms 50 comprise a pair of support arms. The first end of each of the support arms in the pair of support arms may be rotatably connected to opposite sides of the ramp portion 20. Each of the support arms 50 in the pair of support arms may be rotatably connected to the ramp portion 20 via a male connector 80 disposed on the first end of each support arm 50 whereby the male connector 80 is received by the apertures 60 on opposite the sides of the ramp portion 20, as depicted in FIG. 3. The male connector 80 may be a pivot pin or bolt connected to the first end of each support arm 50.

Figure 4:
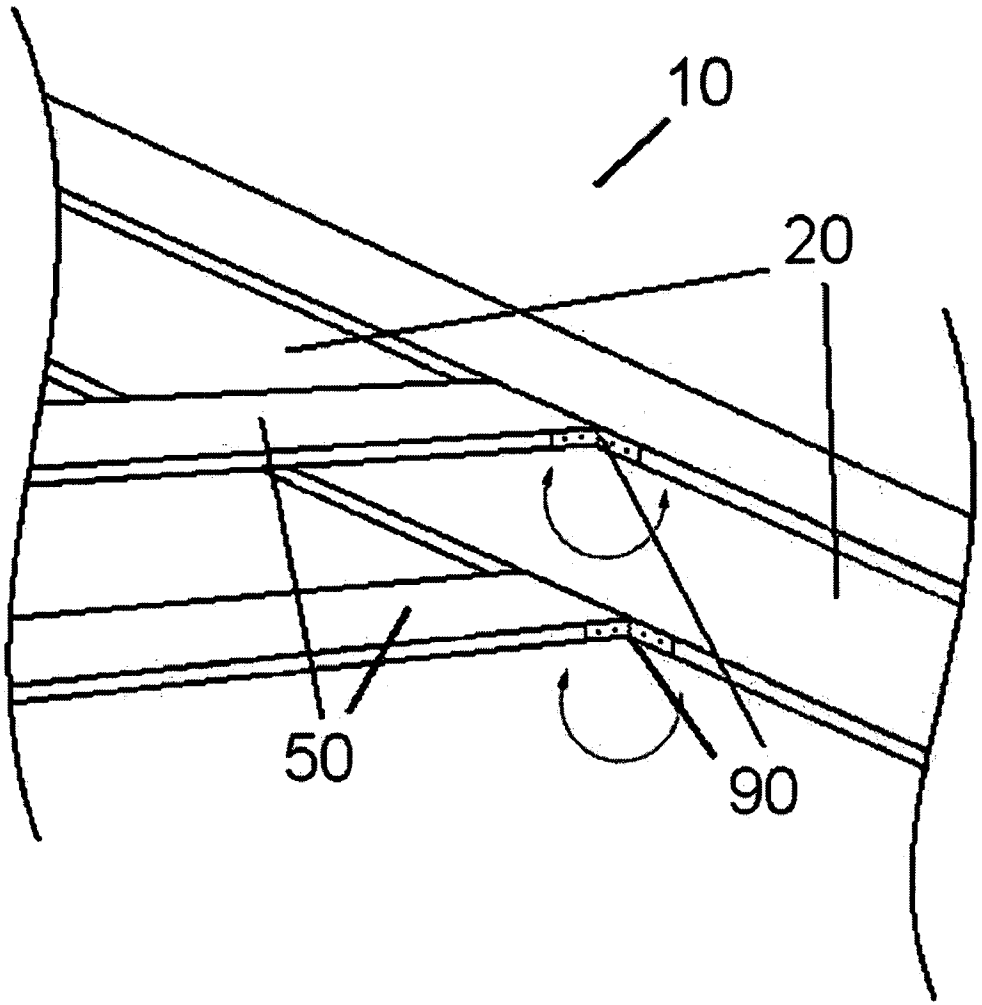
FIG. 4, is a depiction of boarding ramp in accordance with the present invention whereby the support arms are hingedly connected to the ramp portion.

Alternatively, the first end of each of the support arms in the pair of support arms may be hingedly connected to the bottom surface of the ramp portion, as depicted in FIG. 4. Where the one or more support arms are hingedly connected to the ramp portion, the one or more support arms 50 are hingedly connected to the bottom surface of the ramp portion 20 such that the one or more support arms are vertically swingable about the point of attachment to the ramp portion 20. When the one or more support arms comprise one support arm, the one support arm is preferably hingedly connected to the center of the bottom surface of the ramp portion. Where the one or more support arms comprise two support arms, the first end of each support arm is preferably hingedly connected to opposite sides of the bottom surface of the ramp portion. Each of the pair of support arms 50 may be hingedly connected to the bottom of the ramp portion by a hinge 90 or a U-shaped bracket. Where each support arm is hingedly connected to the ramp via a U-shaped bracket, each of the support arms may include one or more pivot pins extending from opposite sides of the first end of each support arm, whereby the portion of the pin or pins extending away from the support arm is received by the U-shaped bracket thereby creating a hinged connection.

Each of the support arms 50 is comprised of a buoyant material and/or has a buoyant material affixed thereto. When the boarding ramp is in a lowered position, the buoyancy of the support arms ensures that the second end of each of the support arms remains at a position proximate to the waterline 100 of the boat 30 thereby providing that the second ends of the support arms contact the boat during use of the ramp in the lowered position. The buoyancy of the support arms also provides that the support arms will be in a position proximate to the waterline 100 of the boat 30 in both rough and calm water.

When the boarding ramp 10 is in the lowered position, as the dog or person enters or exits the boat, the weight of the ramp portion and/or the weight of the dog or person on the ramp portion pushes the second end of the support arms into contact with the boat thereby supporting the ramp portion against the boat 30. The second ends of each of the support arms may be coated with a protective material designed to prevent the support arms from scratching or damaging the area of the boat contacted by the second ends of the support arms. The protective material may be rubber, a polymeric material, or other materials which may be used to prevent the support arms from scratching the boat.

The one or more support arms 50 are comprised of a rigid material capable of supporting the ramp portion against the boat when the boarding ramp is used in the lowered position. The support arms may be comprised of wood, treated wood, metal, composite materials, polymeric materials, and the like.

The pair of support arms may further comprise one or more cross bars 110 connecting each of the support arms 50 in the pair of support arms to one another. By utilizing one or more cross bars 110 both of the support arms will be in the same position with respect to the waterline 100 of the boat. The one or more cross bars may also be used to maintain tension between the first ends of the support bars to ensure the male connectors remain disposed within the pair of opposable apertures on the sides of the ramp portion during use. The cross bars 110 may be designed such that an outwardly force may be applied on the inner sides of the first ends of the support arms allowing the male connectors to be removed from the pair of opposable apertures on the ramp portion thereby allowing the grade of the ramp portion to be adjusted. Each of the cross bars may be comprised of a buoyant material or have a buoyant material attached thereto. Each of the cross bars may be comprised of a rigid material selected from wood, treated wood, metal, composite materials, polymeric materials, and the like.

The boarding ramp is hingedly connected to the boat via one or more hinging units 40. Each hinging unit 40 may be fixedly or detachably connected to the upper end of the ramp portion and fixedly connected or detachably connected to the bow, bow side deck, stern, stern side deck, transom, or gunwale of any type boat or near any part of the edge of the deck of a pontoon boat. Each of the one or more hinging units 40 may comprise any type hinge allowing the boarding ramp to vertically swing about the part of the boat to which the one or more hinging units are fixedly or detachably connected. Preferably, when connected to a flat deck portion of a boat, particularly the flat deck portion of a pontoon boat, the one or more hinging units allow the boarding ramp to lie flat on the deck of the boat when in a closed position thereby allowing for easy storage.

The hinging unit 40 may be fixedly attached to the ramp portion via one or more blocks 41 fixedly attached to the hinging unit and the upper end of the ramp portion. The one or more blocks 41 may each have an angular side adjacent the boat when the ramp is in the lowered position. The angular side of the block 41 allows the ramp to be lowered into the water while not interfering with the hinging unit. The angular side of the block may also rest against the side of the boat when in the lowered position thereby providing additional support to the ramp portion while minimizing stress to the one or more hinging units.

The one or more hinging units 40 may be fixedly attached to the bow, bow side deck, stern, stern side deck, transom, or gunwale of any type boat or near any part of the edge of the deck of a pontoon boat via one or more means for fixedly connecting the boarding ramp to the boat generally known in the art. The one or more means for fixedly connecting the boarding ramp to the boat may be selected from one or more of screws, bolts, glue, epoxy, welding, etc. The one or more means for fixedly connecting the boarding ramp to the boat may be connected to a second block 42 which is fixedly connected to the boat.

Figure 5:
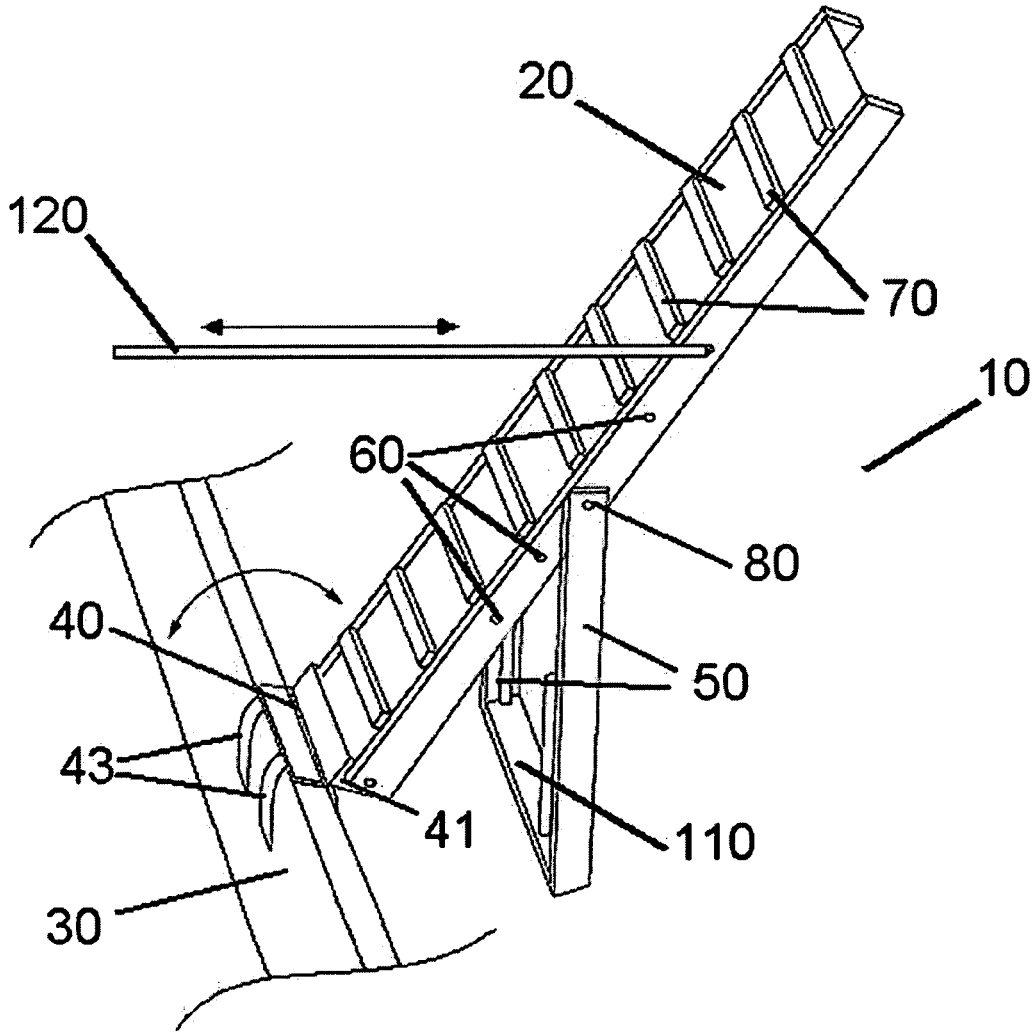
FIG. 5, is a depiction of an alternative embodiment of the present invention whereby the boarding ramp is detachably connected to the boat via a pair of hooks.
Figure 6:
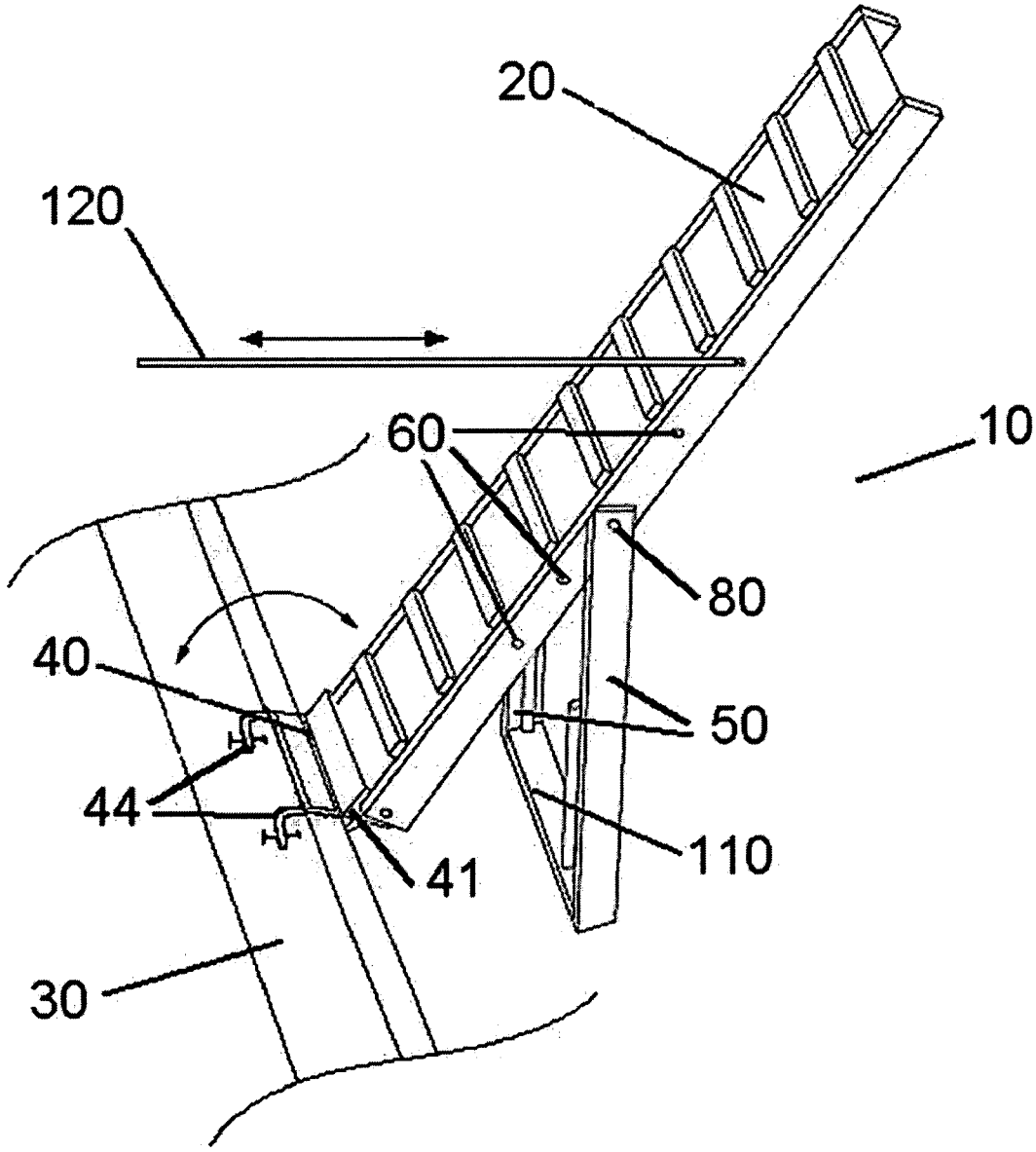
FIG. 6, is a depiction of an alternative embodiment of the present invention whereby the boarding ramp is detachably connected to the boat via a pair of clamps.

Each of the one or more hinging units 40 may comprise one or more hooks 43 and/or one or more clamps 44 for detachably connecting the ramp portion to the bow, bow side deck, stern, stern side deck, transom, or gunwale of any type boat or near any part of the edge of the deck of a pontoon boat. FIG. 5 shows a depiction of an alternative embodiment of the present invention whereby the boarding ramp 10 is detachably connected to the gunwale of a boat via a pair of hooks 43. FIG. 6 shows a depiction of an alternative embodiment of the present invention whereby the boarding ramp 10 is detachably connected to the gunwale of a boat via a pair of clamps 44.

The boarding ramp may further comprises means for swinging the boarding ramp between the raised position and the lower position 120. Such means for swinging the boarding ramp between the raised position and the lower position 120 may be selected from a rope, chain, gaff, hook, pole, or any other objects having one end attachable to the boarding ramp allowing the boarding ramp to be pulled above the waterline and into the boat.

While there have been described what are believed to be the preferred embodiments of the present invention, those skilled in the art will recognize that other and further changes and modifications may be made thereto without departing from the spirit of the invention, and it is intended to claim all such changes and modifications as fall within the true scope of the invention.

The invention claimed is:

1. A boarding ramp for a boat comprising:

a ramp portion having an upper end, a lower end, an upper surface, and a bottom surface, said upper end of said ramp portion being hingedly connected to said boat, said ramp portion having a raised position whereby said ramp portion is above the waterline of said boat and a lowered position whereby said lower end of said ramp portion is at least partially below the waterline of said boat, said ramp portion being vertically swingable between said raised position and said lowered position and freely rotatable about said hinged connection with said boat; and means for supporting said ramp portion between said upper end and said lower end of said ramp portion against the side of said boat upon weight being applied on the upper surface of said ramp portion when in said lowered position and allowing free rotation of said ramp portion about said hinged connection in the absence of weight being applied on the upper surface of said ramp portion when in said lowered position, said supporting means comprising one or more buoyant support arms connected to said ramp portion, said one or more buoyant support arms being vertically swingable with respect to said ramp portion.

2. The boarding ramp according to claim 1, wherein said one or more buoyant support arms each comprise an elongated member having a first end and a second end, said first end of each of said one or more support arms being connected to said ramp portion and said second end of said one or more buoyant support arms being disposed at a position proximate to the waterline of said boat when said ramp portion is in said lowered position.

3. The boarding ramp according to claim 2, wherein said first end of said one or more buoyant support arms is hingedly connected to the bottom surface of said ramp portion.

4. The boarding ramp according to claim 2, wherein said one or more buoyant support arms comprise a pair of support arms, said first end of each of said buoyant support arms being rotatably connected to opposite sides of said ramp portion.

5. The boarding ramp according to claim 4, wherein said support means further comprise a cross bar attaching said pair of buoyant support arms to one another.

6. The boarding ramp according to claim 4, wherein said ramp portion includes one or more pairs of opposable apertures disposed on opposite sides of said ramp portion, said-one or more pairs of opposable apertures receiving means for rotatably connecting said first end of each of said buoyant support arms to said ramp portion.

7. The boarding ramp according to claim 1, wherein each of said one or more buoyant support arms comprise a buoyant material.

8. The boarding ramp according to claim 1, wherein each of said one or more buoyant support arms have a buoyant material attached thereto.

9. The boarding ramp according to claim 1 further comprising a hinging unit fixedly connected to said boat and the upper end of said ramp portion.

10. The boarding ramp according to claim 1 further comprising a hinging unit fixedly connected to said upper end of said ramp-portion and detachably connected to said boat.

11. The boarding ramp according to claim 10, wherein said hinging unit comprises one or more hooks for detachably connecting said ramp portion to said boat.

12. The boarding ramp according to claim 10, wherein said hinging unit comprises one or more clamps for detachably connecting said ramp portion to said boat.

13. The boarding ramp according to claim 1 further comprising a slip resistant material deposited on the upper surface of said ramp portion.

14. The boarding ramp according to claim 1 further comprising a plurality of rectangular steps horizontally disposed on the upper surface of said ramp portion, said plurality of rectangular steps being spacedly disposed from one another.

15. The boarding ramp according to claim 14, wherein a slip resistant material is deposited on one or more of said plurality of rectangular steps.

16. The boarding ramp according to claim 1, wherein said ramp portion comprises one or more telescoping portions.

17. The boarding ramp according to claim 1 further comprising means for swinging said boarding ramp between said raised position and said lowered position, said means being fixedly connected or detachably connected to said ramp portion.

18. The boarding ramp according to claim 1, wherein said boarding ramp rests in said boat when in said raised position.

19. The boarding ramp according to claim 18, wherein said boarding ramp rests flat on the deck of said boat when in said raised position.

20. The boarding ramp according to claim 1, wherein said ramp portion comprises one or more holes extending through said ramp portion from said upper surface to said bottom surface.

* * * * *

UNITED STATES PATENT AND TRADEMARK OFFICE

CERTIFICATE OF CORRECTION

PATENT NO. : 7,011,036 B1
DATED : March 14, 2006
INVENTOR(S) : Jeffery C. Hill

It is certified that error appears in the above-identified patent and that said Letters Patent is hereby corrected as shown below:

Title page,
Item [76], Inventor, "Jeffrey C. Hill" should read -- Jeffery C. Hill --.

Signed and Sealed this

Thirtieth Day of May, 2006

JON W. DUDAS
*Director of the United States Patent and Trademark Office*